US006264474B1

(12) United States Patent
Weller et al.

(10) Patent No.: US 6,264,474 B1
(45) Date of Patent: Jul. 24, 2001

(54) PLUG CONNECTOR

(75) Inventors: Fred Weller, Schorndorf; Detlef Pantring, Ortenberg; Wolfgang Drichelt, Schwaikheim, all of (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/363,913

(22) Filed: Jul. 28, 1999

(30) Foreign Application Priority Data

Jul. 31, 1998 (DE) ..... 198 34 478

(51) Int. Cl.[7] ..... H01R 12/00
(52) U.S. Cl. ..... 439/63; 439/891
(58) Field of Search ..... 439/63, 79, 82, 439/578, 579, 567, 891

(56) References Cited

U.S. PATENT DOCUMENTS

| | | | |
|---|---|---|---|
| 3,403,369 | 9/1968 | Steiff et al. | 439/79 |
| 4,702,707 | 10/1987 | Hillbish | 439/80 |
| 5,364,280 | 11/1994 | Colleran | 439/76 |
| 5,816,855 * | 10/1998 | Pesson | 439/567 |
| 5,842,872 * | 12/1998 | Hosler, Sr. et al. | 439/63 |
| 5,944,536 * | 8/1999 | Seong et al. | 439/79 |
| 5,984,696 * | 11/1999 | Lee | 439/79 |

FOREIGN PATENT DOCUMENTS

| | | |
|---|---|---|
| 42 40 261 A1 | 12/1992 | (DE) . |
| 4434887 A1 | 9/1994 | (DE) . |
| 297 04 161 U1 | 3/1997 | (DE) . |
| 197 14 878 C1 | 4/1997 | (DE) . |
| 0 546 884 A1 | 11/1992 | (EP) . |

* cited by examiner

*Primary Examiner*—Tulsidas Patel
*Assistant Examiner*—T. C. Patel
(74) *Attorney, Agent, or Firm*—Roger C. Turner

(57) ABSTRACT

A plug connector (15) has several contact elements (11) which are provided inside a housing (21). Each contact element having a first connecting end (18) and a second connecting end (19) for connection to bores (17) of a printed circuit board (14). The second connecting end is slit to have radial resiliency. A travel limitation element (23) is provided on the housing. The second connecting element is preferably arranged at right angle with respect to the first connecting element via an adapter element (20).

6 Claims, 3 Drawing Sheets

PLUG CONNECTOR

BACKGROUND OF THE INVENTION

The present invention relates to a plug connector.

Such a plug connector, known from DE 297 04 161 U1, is linearly embodied and is provided on its connecting end with the printed circuit board with a collar surrounding it acting as a travel limitation element. This known plug connector is connected with the printed circuit board in the direction of its longitudinal extension and of the longitudinal extension of the contact element, and therefore perpendicularly in respect to the plane of the printed circuit board, This way of connecting a plug connector with a printed circuit board requires a great amount of space above the plane of the printed circuit board, not only for the connection per se, but also for the plug-in process. This apace, or respectively room, is not available, or respectively provided in many cases.

SUMMARY OF THE INVENTION

It is the object of the present invention to create a plug connector of the type mentioned at the outset which, for the pluggable connection with the printed circuit board, requires less space above the printed circuit board, but nevertheless results in a dependable connection with the printed circuit board.

It is achieved by means of the steps of the invention that the insertion movement of the plug connector toward the printed circuit board required for connecting can take place in a direction parallel with and slightly above the surface of the printed circuit board, so that the plug connector extends less far above the surface of the printed circuit board. The travel limitation element provided on the housing or the printed circuit board leads to a dependable connection and short distances between the housing of the plug connector and the printed circuit board.

It is achieved by means of the characteristics that plugging the plug connector, or respectively its contact elements, into the bores of the printed circuit board can take place without a tilt moment, which possibly could affect the plug connector disadvantageously.

In a preferred development of the present invention, an angle plate is provided on the housing, which rests on the appropriate surface of the printed circuit board and in this way assures an exact and dependable contact, and which can also absorb forces acting on the plug connector during the insertion of the plug.

A further improvement and simplification of the mounting, or respectively pluggable connection of the plug connector on a printed circuit board, along with the simultaneous simplest possible design of an appropriate mounting tool, is achieved.

The contact element can be of one piece, which is possible up to a defined minimal distance between the plug connector and the printed circuit board, since in this case the contact element can be designed to be appropriately angled by simply bending it.

If this said distance between the plug connector and the surface of the printed circuit board falls below a minimum, it is practical to design the contact element in several pieces. Even lower structural heights can be achieved by means of this than is possible with bending the contact elements. This is of particular importance in connection with the increasingly greater packing densities in electronic components. Moreover, this makes it possible to realize different structural heights, since the connecting element on the plug side remains the same and only the structural height, or respectively structural length, of the connecting ends on the printed circuit side is changed. A further advantage lies in realizing different surfaces of the connecting ends, so that they can be matched to the respective functions and requirements. This also applies to a correspondingly optimum selection of the materials on the respective connecting ends. Finally, a variety of combinations is possible, depending on the required design of the shapes of the connecting ends. The engagement area in accordance with the characteristics of claim 4 can be realized in a variety of ways, for example by a transverse bore with or without a pin, by an circular groove with or without a ring, by a cone-shaped collar at the circumference, by surfaces parallel with the surface of the printed circuit board, or the like.

Further details of the invention can be taken from the following description, in which the invention will be described and explained in greater detail by means of the exemplary embodiments represented in the drawings.

DESCRIPTION OF THE PREFERRED EMBODIMENTS

Figure 2:
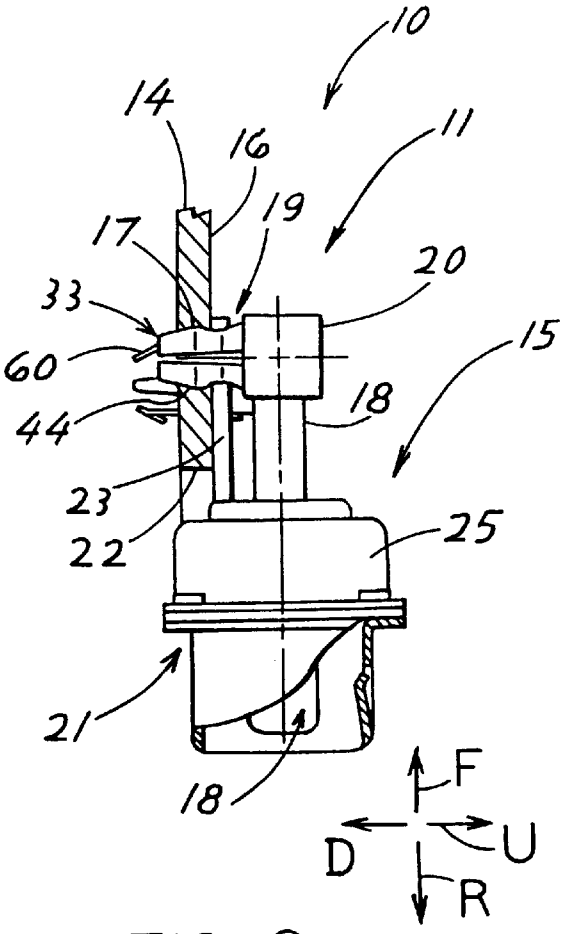
Figure 1:
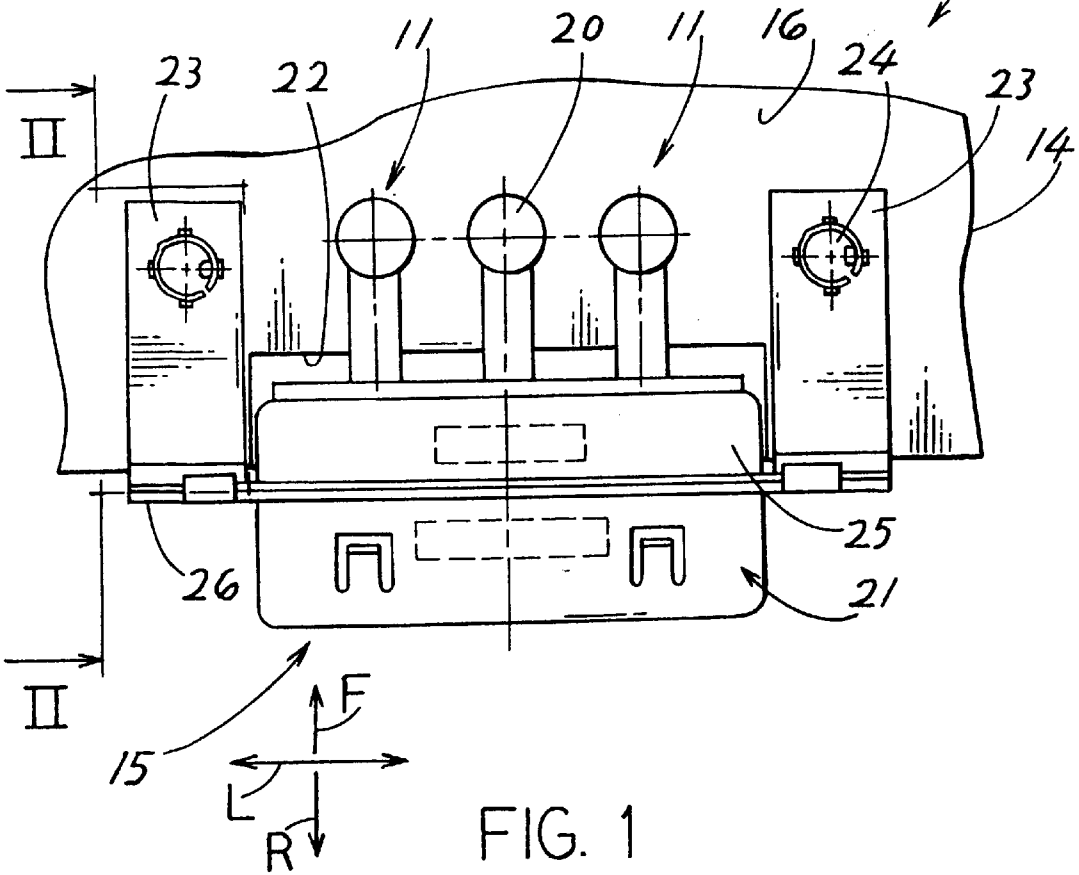
FIG. 1 a plug connector connected with a printed circuit board in accordance with an exemplary embodiment of the present invention in a schematic view from above, FIG. 2 a partially broken open lateral view in accordance with the line II—II, FIG. 3 a contact element used with the plug connector in FIGS. 1 and 2 in a perspective exploded view, FIGS. 4A and 4B representations of a contact element corresponding to FIG. 3, but in accordance with two variations, FIG. 5, a representation corresponding to FIG. 3, but in accordance with another exemplary embodiment of the present invention, and FIG. 6 a perspective representation of a contact element in accordance with a further exemplary embodiment of the present invention.

The installation 10 represented in FIGS. 1 and 2 has a plug connector 15, which is provided with one-piece or multi-piece contact elements 11, 11', 11", 12, or respectively 13, represented in several exemplary embodiments, one end of which is used as a connection with a printed circuit board 14, and the other end as connection with an external plug, not represented. The plug connector 15 extends in a direction parallel with the surface 16 of the printed circuit board 14 and can be connected with the printed circuit board 14 via the contact elements 11, 11', 11", 12, or respectively 13, which are embodied to be angled.

The several, three in the exemplary embodiment, contact elements 11, 11', 11", 12, or respectively 13, of the same kind, which are arranged next to each other, of the plug connector 15 have connecting ends 18 on the plug side, which are aligned, or respectively extend, horizontally, i.e. parallel with the printed circuit board surface 16, and on the printed circuit board side have connecting ends 19 which extend, angled 90° by means of adapters 20, 20', 20", 30, or respectively 40, i.e. perpendicularly in respect to the connecting ends 18, which can be fitted in a pluggable and releasable manner into bores 17, through which contacts extend, of the printed circuit board 14.

To facilitate the description, applicant has provided arrows F, R to represent front and rear directions, arrows U, D to represent up and down directions, and arrows L to represent lateral directions. The circuit board surface 16 may be considered to be the circuit board upper face. The contact elements such as 11 may be considered to extend generally forward F from the connector housing. Each connector element connecting end 18 is a rear portion or part that extends forward from the connector housing. The connecting end 19 is a front portion or part that extends downward U to the circuit board. Of course, the circuit board and connector can be used in any orientation, but the arrows indicate relative orientations of the parts.

As can be seen in FIGS. 1 and 2, the plug connector 15 has a housing 21, in which the connecting ends 18 on the plug side of the contact elements 11, 11', 11", 12, or respectively 13, are held in the axial direction and secured against twisting. The connecting ends 18 on the plug Side, which can be designed pin-like or bushing-like, are here fixed in place in a body of molded material, not represented, fixed in place in a housing element 25. the housing element 25 is arranged in a set-back portion, or slot 22, in an edge of the printed circuit board 14, can be plugged into bores 24 of the printed circuit board 14 and lockingly held by means of two elbows 60. The two elbows 60, which are fastened on side flanges 26 of the housing 21, are used as travel limitation elements when inserting the connecting ends 19 on the plug side of the contact elements 11, 11', 11", 12, or respectively 13, into the bores 17, through which contacts extend, of the printed circuit board 14, so that a press fit corresponding to FIG. 2 is assured at the correct local spot of the connecting end 19 on the side of the printed circuit board. The connection between the plug connector 15 and the printed circuit board 14 takes place in a movement directed perpendicularly in respect to the printed circuit board surface 14 for inserting the connecting ends 19 on the printed circuit board side into the bores 17, through which contacts extend, until contacting, or respectively meeting the appropriate ends of the two angular-shaped travel limitation elements 23. After placement, a rivet or the like for the firm connection between the printed circuit boards 14 and the travel limitation elements 23 can be put through their corresponding bores. In this case, FIG. 2 shows that in the inserted state the structural height of the plug connector 15 above the printed circuit board surface 16 is very low because of use is made of the thickness of the printed circuit board and the required overhang to the other side.

Figures 3, 4A, 4B:
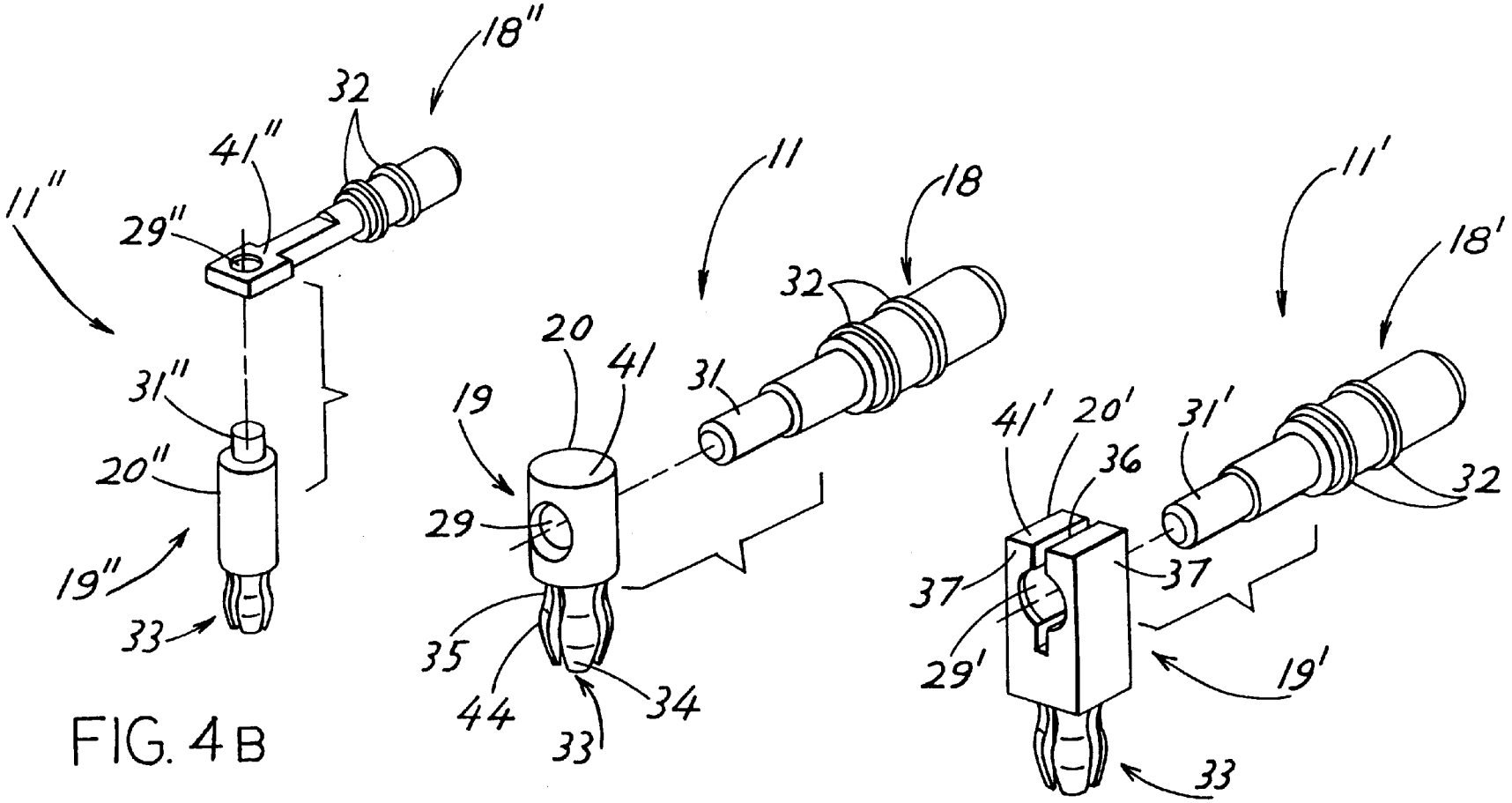
Figure 6:
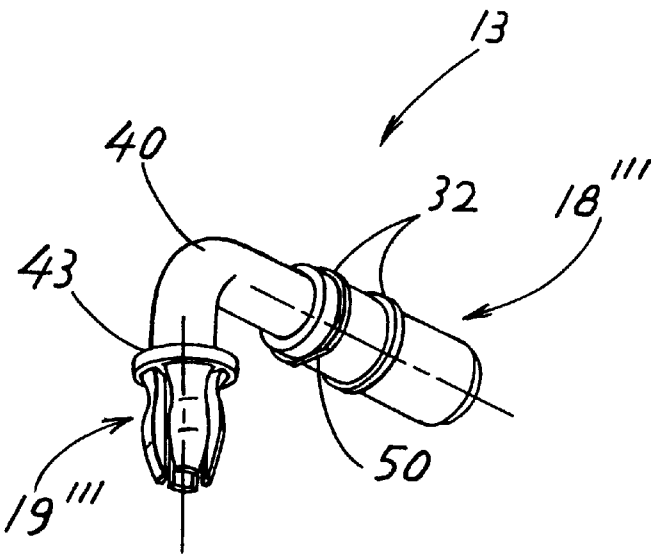

FIG. 3 shows the contact element 11 used in FIG. 2 with the plug connector 15 in an exploded view. The contact element 11 has two parts, i.e. in this exemplary embodiment the connection end 19 on the side of the printed circuit board with the adapter 20 is made of one piece, and the connection end 18 on the plug side is a component which is separate from it and can be connected with the adapter 20. For this purpose, the adapter 20 has a transverse bore 23, which is perpendicular in relation to the axial direction of the connecting end 19 on the side of the printed circuit board, into which a pin 31 can be inserted with clearance fit or press fit, if required with additional riveting, soldering or a comparable mechanical electric connection. At approximately the longitudinal center, the connecting end 18 on the plug side has two annular collars 32, arranged at a distance from each other, via which this component is installed in an axially secure manner in the said body of molded material in the housing element 25. This securing against twisting can be designed as a flattening 50 on one of the annular collars 32, as represented in FIG. 6, so that the contact element 13 cannot turn in the body of molded material.

With all contact elements 11, 11', 11", 12 and 13, the connecting end 19 on the printed circuit board side is double-slit in the insertion area, so that several, here four, radially elastically movable fingers 33 result. On the outside, these fingers 33 are provided on the free front end with a bezel, on the rear end with a waist 35 and in the center with a contact bulge 44. As can be seen in FIG. 2, the press fit of the connecting end 19 on the side of the printed circuit board in the bore 17, through which contacts extend, is such, that the radially prestressed fingers 33 make contact in their area 44 of the greatest diameter in the center of the bore 17.

FIGS. 4A and 4B also show two-part contact elements 11', or respectively 11", wherein the difference between the contact element 11' in accordance with FIG. 4A and the contact element 11 in accordance with FIG. 3 only lies in that the adapter 20' is not embodied cylinder-shaped, but cube-shaped and is provided on its free end with an axial slit 36, so that the legs 37 of the adapter 20' created in this way can be pushed apart in the course of inserting the pin 31 of the connecting end 18 with fit. With the contact element 11" in FIG. 4B, a pin 31" is provided on the adapter 20", while the corresponding transverse bore 29" is provided on a flattened end of the connection 18" on the plug side.

Figure 5:
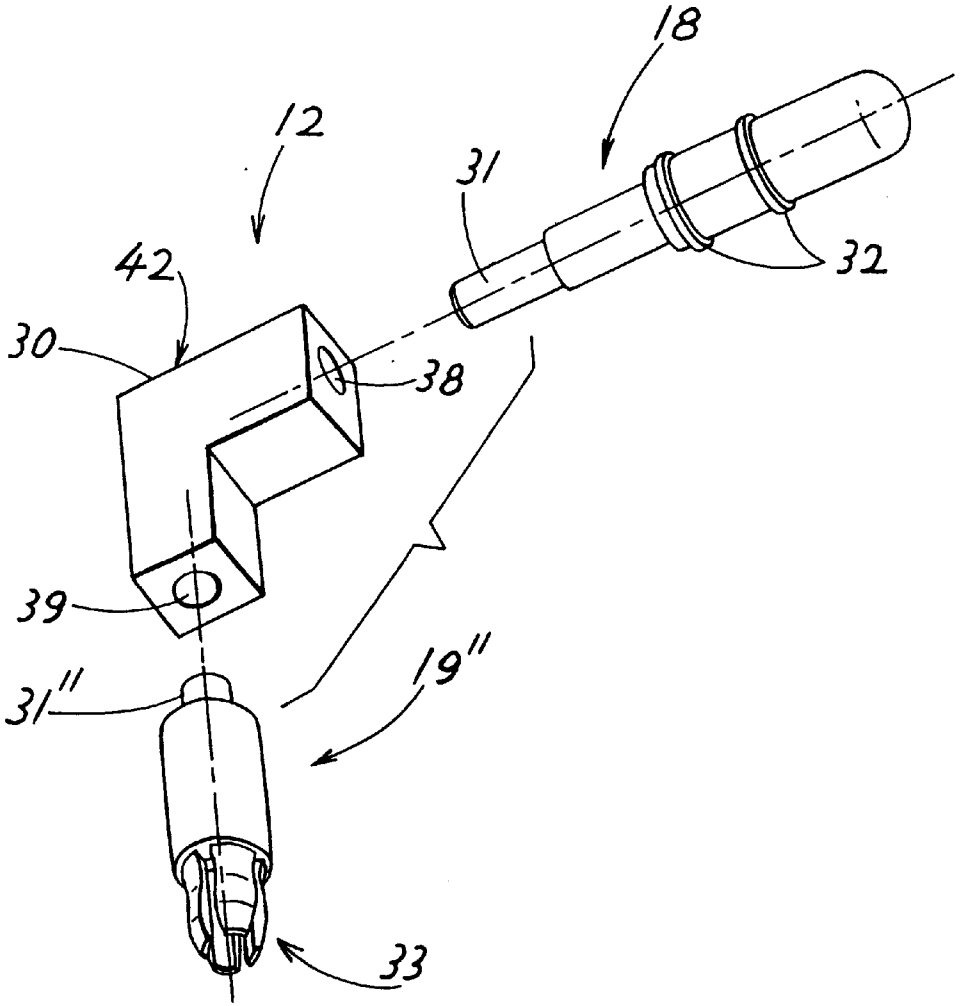

The contact element 12 represented in FIG. 5 is made in three parts, i.e. it is put together from the connecting end 18 on the plug side, the adapter 30, angular-shaped here, and the end 19" on the printed circuit board side in a twist-proof, pluggable press fit or push fit connection. In the represented exemplary embodiment, the angular-shaped (90°) adapter 30 has through bores or blind bores 38, or respectively 39, at the end, into which the pin 31 of the connecting end 18 on the plug side, or respectively the pin 31" of the connecting end 19 on the printed circuit board side can be plugged, fixed against twisting. It should be understood that the angular-shaped adapter 30 can also be replaced by a cube-shaped element with appropriate bores.

FIG. 6 shows the contact element 13 formed in one piece, whose adapter 40 is formed by the 90° arc between the connecting end 18'" on the plug aide and the connecting end 19'" on the printed circuit board side.

The contact elements 11, 11', 11", 12, or respectively 13, are provided with engagement surfaces for introducing a mounting force essentially perpendicularly in relation to the printed circuit board surface 16. This engagement surface is in particular intended to offer a driving surface for a mounting tool. Thus, the contact elements 11 and 11' are provided with a front face 41, 41' at the upper end of the adapter 20, 20', and the contact element 11" with a flat surface 41" on the flattened end of the connecting end 18" on the plug side, for example. Similar is true for the contact element 12, whose adapter 30 Is provided with an upper face 42. A shoulder 43 is provided between the adapter 40 and the connecting end 19 on the printed circuit side of the one-piece contact element 13. It should be understood that these engagement surfaces can also be formed in another shape.

With the exemplary embodiment represented in FIGS. 1 and 2, the travel limitation element 23 is provided on the housing 21 of the plug connector 15. It should be understood that it is also possible to provide one or several travel limitation elements on the printed circuit board 14. By means of a guide, the travel limitation elements are intended to prevent that the plug connector 15 could be subjected to a tilting moment in the course of being attached on, or respectively inserted into the printed circuit board 14.

It should furthermore be understood that instead of being right-angled, the contact elements can also be obtuse-angled.

What is claimed is:

1. A combination of a circuit board which has upper and lower faces each lying in a horizontal plane and a plurality of holes extending between said faces, and a connector which includes a housing and a plurality of contact elements, where each of said contact elements has a rigid rear portion projecting in a forward direction from said housing and has a rigid front portion projecting downwardly into one of said circuit board holes from a front end of said rear portion, wherein:

said housing has laterally opposite housing sides, with said contact elements lying between said housing sides; and including a pair of travel limiting elements that are each laterally spaced from said contact elements, with each travel limiting element extending forwardly from one of said housing sides and lying against said circuit board upper face to prevent tilt of said contact elements with respect to said circuit board, with said housing being devoid of any part lying directly under said circuit board lower face, to thereby allow said contacts to be inserted downwardly through said holes while said travel limiting elements move downward against said circuit board upper face;

said circuit board has an edge and has a slot in said edge, with said housing lying in said slot, as seen in a plan view that is normal to said circuit board upper face and as seen in an edge view of said circuit board, and with parts of said contact element rear portions which lie over said circuit board lying forward of said housing and being exposed at their bottoms so said parts can lie closely over said circuit board.

2. The combination described in claim 1 wherein:

said rear and front portions of said contact elements each consists solely of a separate electrically conductive part, with said front portion having an upper end forming a horizontally-extending hole, and with said rear portion having a large diameter rear end and a smaller diameter front end forming a pin that projects forwardly into the hole.

3. The combination described in claim 1 wherein:

said rear and front portions of said contact elements each consists solely of a separate electrically conductive part, with said front portion having an upper end forming an upwardly-projecting pin, and with said rear portion having a front end forming a vertical hole that receives said pin.

4. A combination of a circuit board which has an upper face lying in a horizontal plane and a plurality of holes, and a connector which includes a housing and a plurality of contact elements, where each of said contact elements has a rear portion projecting in a forward direction from said housing and has a front portion projecting downwardly into one of said circuit board holes from a front end of said rear portion, wherein:

said housing has laterally opposite housing sides, with said contact elements lying between said housing sides; and including a pair of travel limiting elements that are each laterally spaced from said contact elements, with each travel limiting element extending forwardly from one of said housing sides and lying against said circuit board upper face to prevent tilt of said contact elements with respect to said circuit board;

said rear portions of said contact elements have collars that lie substantially against said circuit board upper face.

5. The combination described in claim 4 wherein:

said collars are primarily round, but have flat spots (50) that lie against said circuit board.

6. A combination of a circuit board which has an upper face lying in a horizontal plane and a plurality of holes, and a connector which includes a housing and a plurality of electrically conductive contact elements, where each of said contact elements has a rear portion projecting in a forward direction from said housing and has a front portion projecting downwardly into one of said circuit board holes from a front end of said rear portion, wherein:

each of said rear portions of said electrically conductive contact elements has a part that lies substantially against said circuit board upper face, to prevent tilt of the contact element;

each of said contact element rear portions has a primarily circular collar with a flat spot that lies substantially against said circuit board upper face.

* * * * *